United States Patent [19]

Houghton

[11] Patent Number: 4,897,181

[45] Date of Patent: Jan. 30, 1990

[54] HYDRODESULFURIZATION PRESSURE CONTROL

[75] Inventor: Thomas J. Houghton, Bartlesville, Okla.

[73] Assignee: Phillips Petroleum Company, Bartlesville, Okla.

[21] Appl. No.: 31,962

[22] Filed: Mar. 30, 1987

[51] Int. Cl.[4] ..... C10G 45/00

[52] U.S. Cl. ..... 208/209; 208/79; 208/DIG. 1; 364/500; 364/510; 364/550

[58] Field of Search ..... 208/DIG. 1, 209, 79; 364/500, 510, 550

[56] References Cited

U.S. PATENT DOCUMENTS

| | | | |
|---|---|---|---|
| 2,769,753 | 11/1956 | Hutchings et al. | 208/79 |
| 2,965,561 | 12/1960 | Carr et al. | 208/79 |
| 2,969,316 | 1/1961 | Stanford et al. | 208/79 |
| 3,725,252 | 4/1973 | Maier | 208/213 |
| 3,801,494 | 4/1974 | Moore et al. | 208/79 |
| 4,190,520 | 2/1980 | Gewartowski | 208/95 |
| 4,477,413 | 10/1984 | Carson | 208/DIG. 1 |
| 4,479,189 | 10/1984 | Carson | 208/DIG. 1 |
| 4,498,916 | 2/1985 | Jensen | 62/61 |
| 4,551,235 | 11/1985 | Carson | 208/DIG. 1 |
| 4,617,110 | 10/1986 | Hinojos et al. | 208/DIG. 1 |

*Primary Examiner*—Asok Pal

*Attorney, Agent, or Firm*—George E. Bogatie

[57] ABSTRACT

The pressure of a source of hydrogen-rich gas, which is generated at an elevated pressure as a by-product in a reforming process, is controlled by manipulating two vent valves so as to permit maximum utilization of the hydrogen-rich gas in a hydrodesulfuration process which consumes hydrogen in its operation. Control action to maintain the pressure of the source of hydrogen-rich gas requires that hydrogen-rich gas generated in the reforming process, which must be vented to reduce pressure, is vented through a hydrodesulfurization reactor in ample quantity for operation of the hydrodesulfurization reaction, and only that amount of hydrogen-rich gas which cannot be utilized in the hydrodesulfurization reactor is vented directly from the source of hydrogen-rich gas.

6 Claims, 1 Drawing Sheet

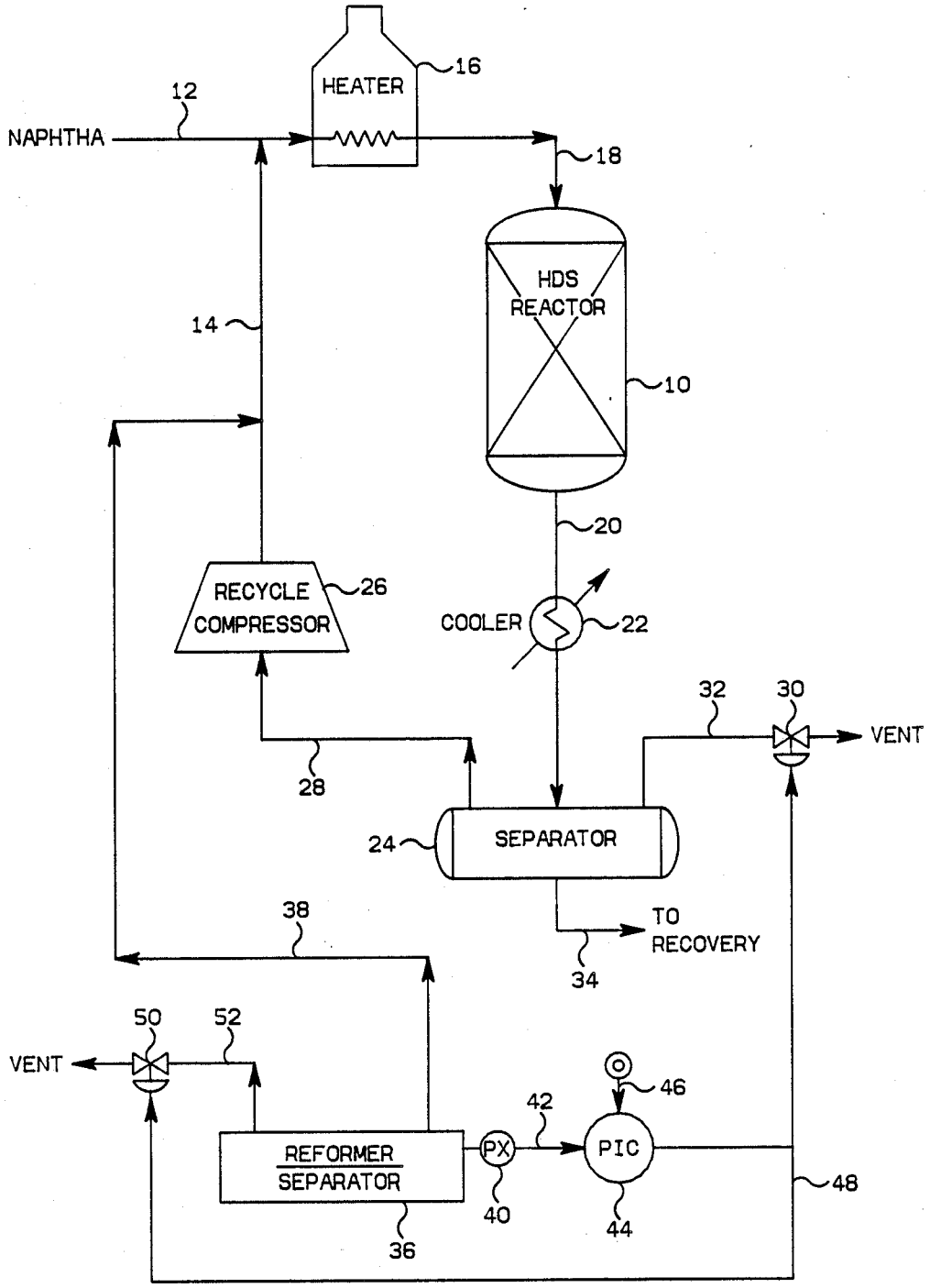
HEATER
16
12
NAPHTHA
18
HDS
REACTOR
14
10
20
RECYCLE
COMPRESSOR
26
COOLER
22
32
30
VENT
28
24
SEPARATOR
38
TO
RECOVERY
34
50
52
VENT
46
42
REFORMER
SEPARATOR
PX
PIC
48
40
44
36

HYDRODESULFURIZATION PRESSURE CONTROL

This invention relates to automatic control of a process for hydrodesulfurization of petroleum hydrocarbons. In one aspect it relates to method and apparatus for controlling the pressure in a hydrodesulfurization process which utilizes hydrogen-rich gas formed as a by product in a catalytic reforming process.

Various procedures are known to hydrodesulfurize (HDS) a petroleum naphtha or a petroleum hydrocarbon fraction boiling in the gasoline boiling range. In addition hydrodesulfurization processes may be used to treat other heavier distillate fractions such as gas oil or lubricating oil stock. As used herein "hydrodesulfurization" is a process employing an extraneous source of hydrogen and resulting in a net consumption of hydrogen for the purpose of reducing the concentration of a sulfur contaminant contained in petroleum hydrocarbons.

Typically the extraneous, or so called make-up, hydrogen required for a naphtha hydrodesulfurization process is combined with a hydrogen recycle gas stream and the combined stream is introduced into the low pressure inlet of an HDS recycle compressor. The thus compressed hydrogen-rich gas is contacted with the naphtha in a hydrodesulfurization reactor.

In the refining of naphtha, processes for the reforming of naphtha to provide higher octane number hydrocarbon blending components for gasoline are typically utilized in addition to the hydrodesulfurization processes. Since the reforming process produces, in the form of a by-product, large volumes of gas containing hydrogen in reasonable concentration and available at elevated pressure, it would be desirable to directly utilize at least a portion of the by-product hydrogen-rich gas at high pressure from the reforming process as the make-up hydrogen required for the desulfurization process. Clearly, it is uneconomical to depressurize a source of make-up hydrogen from a reforming process and then pass it into the low pressure inlet of an HDS recycle compressor in a typical naphtha hydrodesulfurization process.

It is thus an object of this invention to automatically control the pressure of a source of hydrogen associated with a reforming process in such a manner that the hydrodesulfurization process utilizes the maximum amount of hydrogen from the reforming process. It is a further object of this invention to reduce the required gas handling capacity for the HDS recycle compressor.

In accordance with the present invention method and apparatus are provided for automatically throttling two hydrogen-gas vent valves on separator vessels associated respectively with the reforming process and the hydrodesulfurization reactor to maintain a desired pressure for the extraneous source of hydrogen. This is accomplished with a split-range control signal that responds to the actual pressure of the source of hydrogen.

Direct acting control valves are utilized with the split-range controller. These control valves are modified so that the vent valve for the HDS reactor separator opens in response to increasing pressure before the gas vent valve for the reformer separator opens. Since the hydrogen-gas that is vented through the HDS reactor separator vent valve must first pass through the HDS reactor, a fully open position for the HDS reactor vent valve means that essentially all of the hydrogen required for the hydrodesulfurization process is supplied from the reformer process on a once through basis.

This results in efficient operation of the hydrodesulfurization process since, if essentially all of hydrogen-gas is automatically supplied from the reforming process, a utility savings and a reduction in gas handling capacity are achieved for the HDS recycle compressor.

Other objects and advantages will be apparent from the foregoing brief description of the invention and the claims as well as the detailed description of the drawing which is a diagrammatic illustration of a hydrodesulfurization process with the pressure control system of the present invention.

The invention is illustrated and described in terms of a particular process for hydrodesulfurization of naphtha. However, the problem of controlling the pressure of an extraneous source of hydrogen is broadly applicable to processes which consume hydrogen in their operation. Therefore this invention is applicable to any hydrodesulfurization process where gas is vented from the hydrodesulfurization process in order to control pressure of a source of hydrogen associated with a reforming process.

BRIEF DESCRIPTION OF DRAWINGS

A specific control system configuration is set forth in the FIGURE for sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors and the signals provided to control valves will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

The controllers shown may utilize the various modes of control such as proportional, proportional-integral, proportional-derivative, or proportional-integral-deravitive. In this preferred embodiment, proportional-integral-deravitive controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of such gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one of more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirement of the particular installation, safety factors, the physical characteristics of the measuring or control instruments and other similar facts. For example, a raw flow measurement signal produced by a differential pressure orifice flow meter would ordinarily exhibit a generally proportional relationship to the square of the actual flow rate. Other measurements instruments might produce a signal which is proportional to the measured parameter, and still other transducing means may produce a signal which bears a more complicated, but known, relationship to the measured parameter. In addition, all signals could be translated into a "suppressed zero" or other similar format to provide a "live zero" and prevent an equipment failure from being interpreted as a low (or high) measurement or control signal. Regardless of the signal format or the exact relationship of the signal of the parameter which it represents, each signal representative of a measured process parameter or representative of a desired process value will bear a relationship to the measured parameter or desired value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to the drawing, there is illustrated a catalytic hydrodesulfurization reactor 10 which can be utilized to remove sulfur contaminants from petroleum hydrocarbons. Naphtha, for example, in feed conduit means 12 is combined with a hydrogen-rich gas stream flowing in conduit means 14. The hydrogen-rich gas stream flowing in conduit means 14 contains ample hydrogen for the desulfurization of naphtha or other petroleum hydrocarbon flowing in conduit means 12. The thus combined feed stream is passed through heater 16, operably located in conduit means 18, where the temperature of the feed is increased to reaction temperature. The preheated feed, which can be a vapor, liquid or of mixed hydrocarbon phases is passed through conduit means 18 to reactor 10, and contacts the catalyst bed in the reactor. The main reaction in reactor 10 is the elimination of sulfur in the form of hydrogen sulfide.

The reaction effluent is removed from the reactor 10 through conduit means 20 and after heat exchange and cooling in effluent heat exchanger 22 the reactants pass to reactor separator 24 where hydrogen rich gases are removed from the liquid product.

A portion of the separated hydrogen rich gases in separator 24 may be recycled, as required, to reactor 10 through recycle compressor 26, which is preferably a centrifugal compressor, via conduit means 28, 14, and 18. Also at least a portion of the separated hydrogen rich gases in separator 24 is vented, for example to relieve pressure through control valve 30 which is operably located in conduit means 32. The liquid product from separator 24 is depressurized and passed to a recovery section through conduit means 34.

Reformer separator 36 provides an extraneous source of hydrogen rich gas which is supplied to reactor 10 through the combination of conduit means 38, 14 and 18. Depending on the quantity of hydrogen rich gas available from reformer separator 36, the hydrogen-rich gas flowing in conduit means 38 may be combined with hydrogen-rich gas compressed in recycle compressor 26, to form a combined recycle and make-up hydrogen-rich steam flowing in conduit means 14. Where hydrogen is plentiful from the extraneous source 36 a once through hydrogen gas system may be employed where the total hydrogen in conduit means 14 is provided from reformer separator 36. If hydrogen in excess of the quantity required by the desulfurization reactor 10 is available in reformer separator 36, it can be vented through control valve 50 which is operably located in conduit means 52.

A hydrodesulfurization process utilizing an extraneous source of hydrogen has been described to this point. However, it is the manner in which the process is controlled so as to maintain a desired pressure for the extraneous source of the hydrogen that provides the novel features of the present invention.

Pressure transducer 40 in combination with a pressure measuring device operably located in the upper portion of reformer separator 36 provides an output signal 42 which is representative of the actual pressure in reformer separator 36. Signal 42 is provided as a first input to split-range pressure controller 44. Split-range pressure controller 44 is also provided with a setpoint signal 46 which is representative of the desired operating pressure for reformer separator 36. In response to signals 42 an 46, split-range pressure controller 44 provides a control signal 48 which is responsive to the difference between signals 42 and 46. Signal 48 is representative of the positions of control valve 30, which is operably located in vent conduit means 32, and control valve 50, which is operably located in vent conduit means 52, required to maintain the actual pressure in reformer separator 36 which is represented by signal 42 substantially equal to the desired pressure represented by signal 46. Signal 48 is provided from split-range pressure controller 44 as a control signal to control valves 30 and 50.

Control valves 30 and 50 are modified for direct acting split-range operation so that instead of modulating from closed to fully open for the full scale output of the controller (e.g. 3–15 psig) they are made to operate over a portion of the range of their control signal. In this preferred embodiment control valve 30 is modified such that it is closed for signals from 3–4 psig, then it modulates from closed to fully open for signals from 4–9 psig and is fully open from 9–15 psig. Likewise, control valve 50 is modified such that it is closed for signals from 3–9 psig then it modulates from closed to fully open for signals from 9–14 psig and is fully open from 14–15 psig. Split-range pressure controller 44 manipulates control valves 30 and 50 to thereby throttle the flow of hydrogen-gases from reactor separator 24 and reformer separator 36 so as to maintain a desired pressure in reformer separator 36.

The essential feature of split-range pressure controller 44 is to vent hydrogen-rich gas through control valve 30 before any hydrogen rich gas is vented through control valve 50. This insures that, if hydrogen-rich gas is available from reformer separator 36, it will pass through reactor 10 and at least be partially consumed in reactor 10 before being vented. In this manner the utility requirements and also the gas handling capacity for recyle compressor 26 are reduced since the requirement for compressed recycled hydrogen-rich gas is reduced if the hydrogen-rich gas can be supplied from reformer separator 36.

This invention has been described in terms of a preferred embodiment illustrated in the FIGURE. Specific components used in the practice of the invention as illustrated in the FIGURE such as pressure transducer 40, control valves 30 and 50 and controller 44 are each well known commercially available components such as are described at length in Perry's Chemical Engineer Handbook, 5th Edtion, Chapter 22, McGraw-Hill.

For reasons of brevity conventional axillary equipment required for the hydrodesulfurization process such as pumps, additional separators, additional heat exchangers, additional measurement and control components, etc. have not been included in the above description since they play no part in the explanation of the invention. While the invention has been described in terms of the presently preferred embodiment reasonable variations and modifications are possible by those skilled in the control systems art within the scope of the described invention and the appended claims.

That which is claimed is:

1. A method for controlling the pressure of a source of hydrogen-rich gas in a reforming process wherein a source stream of hydrogen-rich gas supplied from said source of hydrogen-rich gas is combined with a hydrocarbon containing fluid stream to form a combined feed stream which is provided to a hydrodesulfurization reactor, and wherein excess hydrogen-rich gas in said hydrodesulfurization process and excess hydrogen-rich gas in said reforming process are vented through a first control valve and a second control valve respectively, said method comprising the steps of:

establishing a first signal representative of the actual pressure of said source of hydrogen;

establishing a second signal representative of a desired pressure for said source of hydrogen wherein said desired pressure for said source of hydrogen is compatible with a desired pressure for said reactor;

comparing said first signal and said second signal and establishing a third signal which is responsive to the difference between said first signal and said second signal;

modifying said first control valve and said second control valve so that said first control valve begins to open at a lower pressure signal than said second control valve begins to open, and manipulating said first control valve and said second control valve in response to said third signal to thereby maintain said actual pressure for said source of hydrogen represented by said first signal substantially equal to said desired pressure represented by said second signal, wherein the manipulation of said first control valve and said second control valve in response to said third signal results in the venting of an ample amount of hydrogen-rich gas for operation of said reactor through a path including said reactor and said first control valve, before venting any hydrogen-rich gas through said second control valve, to thereby insure maximum utilization in said reactor of hydrogen-rich gas from said source of hydrogen-rich gas.

2. A method in accordance with claim 1 wherein additional hydrogen-rich gas is provided to said reactor through a recycle compressor having a suction inlet and a discharge outlet, additionally comprising the steps of:

providing a recycle hydrogen-rich gas stream from a separator associated with said reactor to said suction inlet of said recycle compressor;

combining a compressed recycle hydrogen-rich gas stream from said discharge outlet of said recycle compressor with said source stream of hydrogen-rich gas to form a combined recycle and make-up hydrogen-rich stream, and wherein said combined recycle and make-up hydrogen-rich stream is combined with said source stream of hydrogen-rich gas before said source stream of hydrogen-rich gas is combined with said hydrocarbon containing stream, and wherein said combined recycle and make-up hydrogen-rich gas stream is combined with said hydrocarbon containing fluid stream to form said combined feed stream.

3. A method in accordance with claim 1 wherein said hydrocarbon containing stream is a naphtha stream.

4. A method in accordance with claim 1 wherein said first control valve is fully open in response to said third signal before said second control valve begins to open.

5. A method in accordance with claim 1 wherein excess hydrogen-rich gas is vented through said first control valve and said second control valve to a fuel gas system.

6. A method in accordance with claim 1 wherein modifying said first control valve comprises setting said first control valve so that it is closed for signals from 3–4 psig, and modulates from closed to fully open for signals from 4–9 psig and is fully open for signals from 9–15 psig and manipulation of said second control valve comprises setting said second control valve so that it is closed for signals from 3–9 psig, modulates from closed to fully open for signals from 9–14 psig and is fully open from 14–15 psig.

* * * * *